US005251790A

United States Patent [19]

Cohn et al.

[11] Patent Number: 5,251,790

[45] Date of Patent: Oct. 12, 1993

[54] MOBILE BAR FOR DISPENSING COLD BEVERAGES

[76] Inventors: Robert J. Cohn, 61 Sterling Ave., Dallas, Pa. 18612; Albert Kolvites, R.R. 3, Box 117A, Yeager Rd., Mountaintop, Pa. 18707

[21] Appl. No.: 939,693

[22] Filed: Sep. 2, 1992

[51] Int. Cl.[5] ..... A47B 96/18; A47F 9/00; B67D 5/62

[52] U.S. Cl. ..... 222/146.6; 62/258; 62/390; 62/393; 222/609; 312/140.1

[58] Field of Search ..... 222/146.6, 129.1–129.4, 222/144.5, 608, 609; 312/140.1, 140.2, 140.3; 62/258, 390, 393

[56] References Cited

U.S. PATENT DOCUMENTS

| | | | |
|---|---|---|---|
| D. 258,478 | 3/1981 | Zola | 312/140.2 X |
| 1,012,621 | 12/1911 | Friese | 222/146.6 X |
| 1,283,330 | 10/1918 | Sebring | 312/140.1 X |
| 1,321,731 | 11/1919 | Gill | 62/258 X |
| 1,385,478 | 7/1921 | Shemilt | 312/140.1 |
| 1,862,654 | 6/1932 | Booth | 312/140.1 X |
| 1,885,092 | 10/1932 | Fellerman | 312/140.1 |
| 2,073,955 | 3/1937 | Ackerman | 312/140.1 |
| 2,086,832 | 7/1937 | Vincent | 312/140.1 |
| 2,165,930 | 7/1939 | Levine et al. | 312/140.1 |
| 2,211,428 | 8/1940 | Matot | 312/140.1 |
| 2,238,193 | 4/1941 | Stephens | 62/258 X |
| 2,677,241 | 5/1954 | Schmock | 62/393 X |
| 2,681,549 | 6/1954 | Maxwell | 222/146.6 X |
| 2,736,464 | 2/1956 | Walton | 222/129.1 |
| 2,750,076 | 6/1956 | Welty et al. | 222/146.6 X |
| 2,871,675 | 2/1959 | Cornelius | 62/258 |
| 3,180,529 | 4/1965 | Buffington | 222/609 X |
| 3,240,395 | 3/1966 | Carver | 222/129.1 |
| 3,327,902 | 6/1967 | Alterwitz | 222/129.1 X |
| 3,331,536 | 7/1967 | DeLorenzo | 222/129.1 X |
| 3,904,079 | 9/1975 | Kross | 222/146.6 X |
| 3,983,583 | 10/1976 | Herman et al. | 312/140.2 X |
| 4,678,104 | 7/1987 | Pritchett | 222/146.6 |
| 5,056,686 | 10/1991 | Jarrett | 222/144.5 X |
| 5,152,429 | 10/1992 | Billings | 222/144.5 X |
| 5,192,003 | 3/1993 | Billings | 222/129.1 |

*Primary Examiner*—Kevin P. Shaver
*Attorney, Agent, or Firm*—Michael Ebert

[57] ABSTRACT

A two-piece mobile bar which may house a beverage cooling and dispensing system for dispensing cold beverages through a multi-valved gun operated by a bartender stationed behind the bar. The first piece is a base unit defined by vertical end walls bridged by upper and lower sections, the upper section being joined to the end walls at corresponding positions below the upper edges of the end walls. The space between the upper and lower sections is divided into open cells which receive beverage and other containers. The upper section is provided with a sink in which a cold plate is seated, the cold plate having coils embedded therein in heat exchange relationship with ice covering the plate. The coil inputs are coupled to the containers and the outputs to the gun, whereby beverages passing through the coils are cooled before being dispensed. Coupling is effected by a network of hoses which extend through a shallow region contiguous with the front side of the unit. The second piece of the bar, which is detachable from the first, is an integrated serving counter/apron assembly whose counter rests on the upper edges of the end walls and whose apron covers the front side of the unit and conceals the network of hoses and the containers.

14 Claims, 4 Drawing Sheets

Fig. 5.
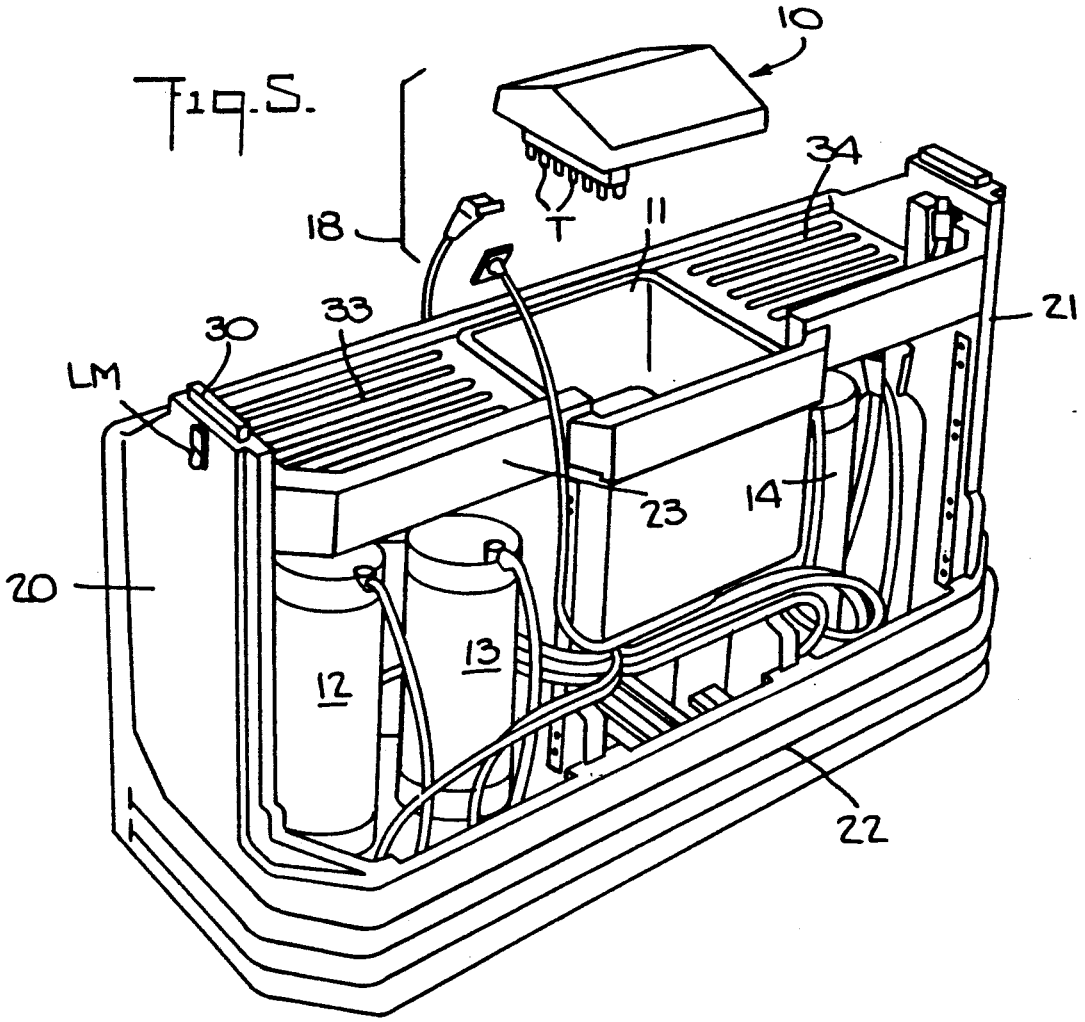
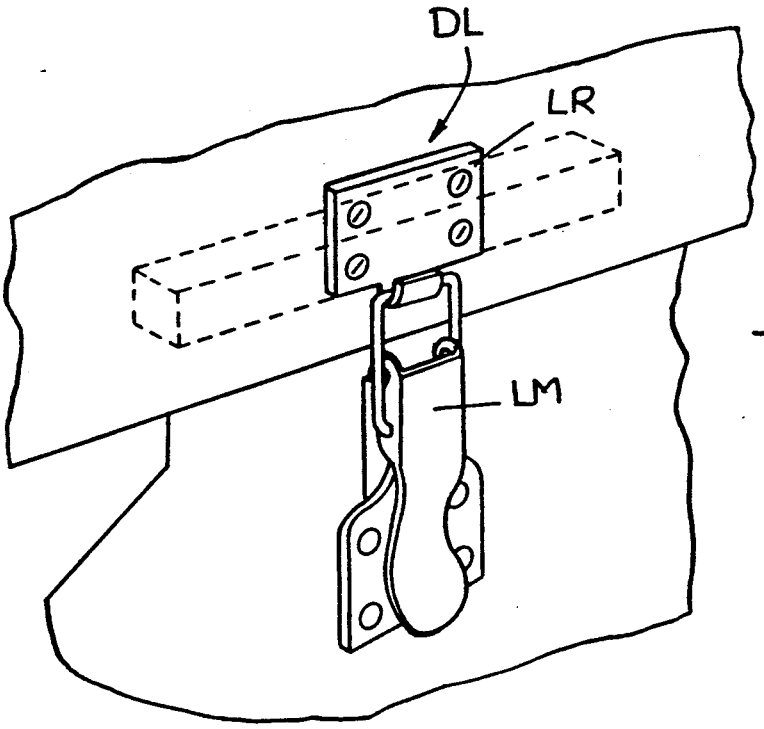
Fig. 4A.

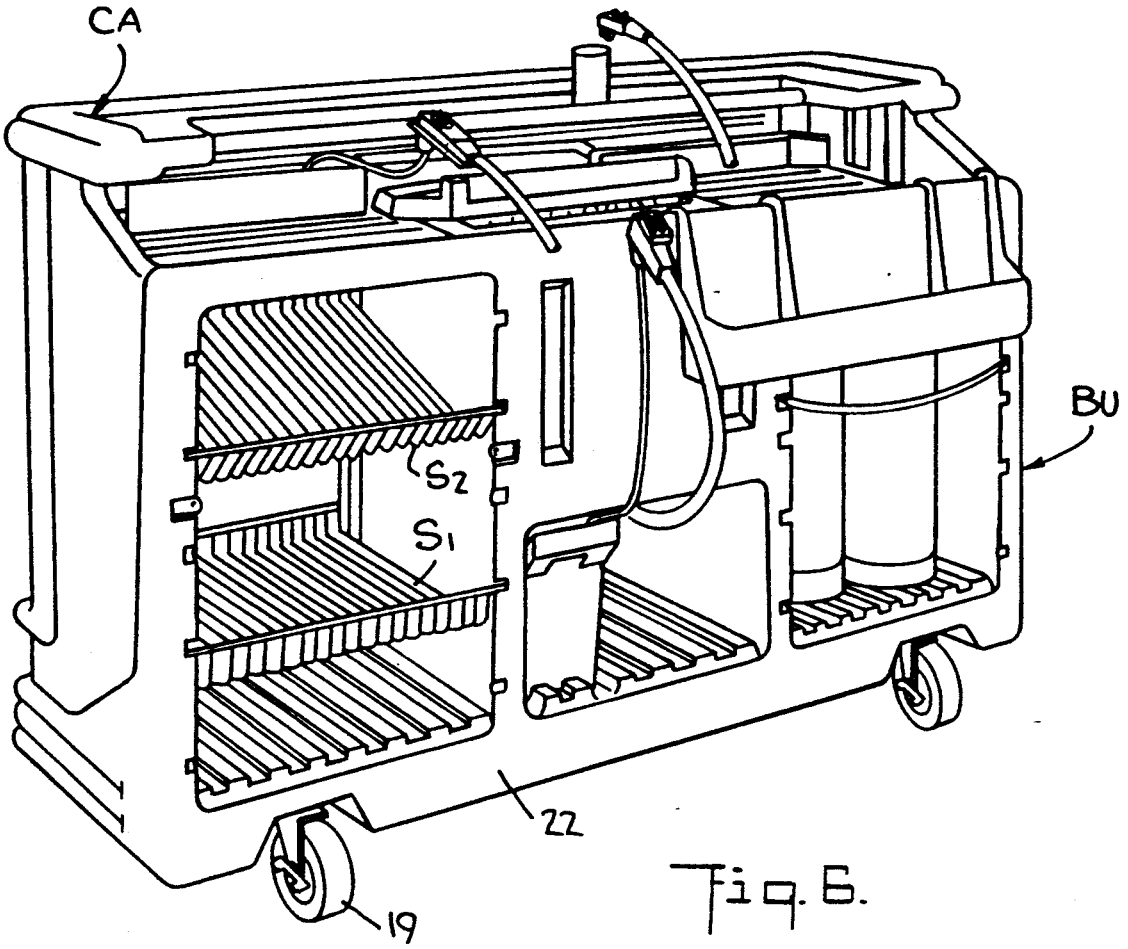
Fig. 6.
Fig. 7.
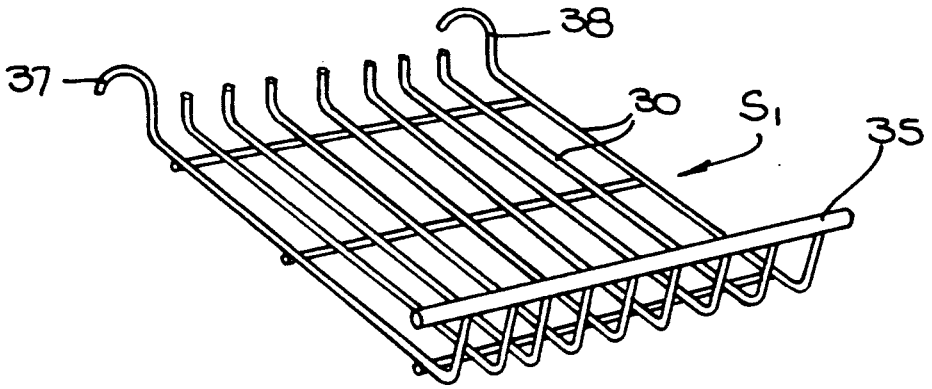

MOBILE BAR FOR DISPENSING COLD BEVERAGES

BACKGROUND OF INVENTION

1. Field of Invention

This invention relates generally to mobile bars for dispensing cold beverages, and in particular to a two-piece bar, one piece of which is a base unit having open cells in which are received beverage containers that are coupled through the coils of a cold plate seated in a sink in the upper section of the unit to a dispensing gun, coupling being effected by a network of hoses running through a shallow region contiguous to the front side of the unit, the other piece, which is detachable from the first, being an integrated serving counter/apron assembly in which the counter is seated on top of the unit above the sink and the apron covers the front side of the unit, whereby when the assembly is detached therefrom, access is then had to the hose network, the containers, and the interior of the bar to permit their cleaning to maintain the bar in a sanitary condition.

2. Status of Prior Art

Mobile bars for use in hotels, restaurants, convention centers and outdoor affairs for selectively dispensing cold beverages are well known. These widely used mobile bars, when used with a beverage dispensing system, eliminate the need for bottle service, which is not only costly, but also messy.

When cold carbonated beverages such as "Coca Cola", "7-Up" and Ginger Ale are to be served to a large number of guests, or beer, wine and juices, and where electrically-powered refrigerators are not available to cool these beverages, a mobile bar for this purpose makes use of a so-called cold plate seated in a sink and covered with ice.

Embedded in the cold plate, which may be cast of aluminum or other metal having high thermal conductivity are cooling coils whose inputs are coupled by hoses to supply cylinders or other containers for the different beverages, and whose outputs are coupled by hoses through a manifold to a multi-valved dispenser gun to selectively dispense the beverages. These beverages are cooled as they pass through the cooling coils which are in heat-exchange relation to the ice. The ice is usually in the form of ice cubes which are also used to provide drinks on the rocks.

A pre-mix system is used when the beverages are fully constituted and in condition to be served. Thus if to be dispensed are "Coca-Cola", "7-Up" soda, ginger ale and other soft drinks, then these may be contained in 5 gallon supply cylinders into whose inputs are fed pressurized carbon dioxide drawn from a $CO_2$ cylinder. The pressurized output of the soda supply cylinders are fed by separate hoses to the cooling coils embedded in the cold plate.

In a post-mix system the beverages are not fully constituted but are in syrup form. Thus the supply may take the form of 5 gallon supply cylinders or plastic-lined boxes containing the syrups for the respective sodas to be dispensed. These syrups are intermingled with carbonated water obtained from a carbonator coupled to a pressurized water supply. But whether a pre-mix or a post-mix system system is employed, cooling of the beverages takes place in the cold plate through whose cooling coils the beverages are caused to flow.

Of prior art interest is the Pritcheet patent 4,678,104 (1987), which discloses a cooling system for dispensing beverages. Use is made for this purpose of a tub adapted to accommodate a cold plate having cooling coils cast therein. The cold plate, which has a block-like form, is covered by ice cubes; hence the beverages passing through these coils are brought to a low temperature.

A conventional mobile bar is constituted by a one-piece unit provided with casters so that the unit can be wheeled without difficulty to a desired site at which cold beverages are to be served. The unit is divided into internal compartments or cells for accommodating containers for the beverages to be dispensed. These containers are coupled by hoses to the inputs of the coils embedded in a cold plate seated in a sink and covered by ice cubes. The outputs of these coils are coupled by hoses leading to the dispensing gun.

A typical mobile unit bar is fabricated of plywood covered with a plastic laminate, the bar being divided into compartments or cells to house the beverage containers and all other elements necessary to the operation of the bar.

The network of hoses which intercouple the coils of the cold plate to the beverage containers and the multi-valved dispensing gun are usually routed through holes bored in the walls of the unit. In the course of use, dirt and sticky liquids accumulate on the network of hoses and on the containers and other elements of the beverage cooling and dispensing system, particularly when the bar is used in an outdoor environment. Also, some degree of leakage may be experienced within the system, and this liquid may find its way into the holes bored in the walls where the liquid is absorbed by the plywood. As a result, the wood becomes a breeding ground for bacteria, and swelling of the wood delaminates the plastic covering.

It is essential that a mobile bar, however heavily used, be maintained in a clean, sanitary condition, particularly in an environment in which food as well as beverages is served. With a conventional mobile bar, it is difficult to obtain full access to the beverage containers, the network of hoses and the bar interior for purposes of carrying out a thorough cleaning operation, for the bar is open only at its rear side where the bartender normally stands, and many of the hoses are buried well within the bar structure.

SUMMARY OF INVENTION

In view of the foregoing, the main object of this invention is to provide a mobile bar in which a cold plate is seated in a sink and is coupled by a network of hoses to beverage containers housed within the bar and to a multi-valved gun for selectively dispensing the beverages, this hose network and the containers being readily accessible so that they can be cleaned and the bar maintained in a sanitary condition.

More particularly, an object of this invention is to provide a two-piece bar, one piece being a base unit in which the beverage containers and other elements of the beverage cooling and dispensing system are housed, the other piece, which is detachable from the base unit, being an integrated serving counter/apron assembly whose counter is seated on top of the unit and whose apron then covers the front side thereof, the assembly, when detached from the base unit, giving access to the hoses and the containers to permit a thorough cleaning thereof.

A significant feature of a mobile bar in accordance with the invention is that the beverage containers are received in open cells in the base unit whereas the network of hoses are not routed through the holes bored in walls of the unit, but pass through a shallow region contiguous with the front side of the unit, whereby when the assembly is detached from the unit, the hoses and all elements to be cleaned are directly accessible.

Also an object of the invention is to provide a two-piece mobile bar that operates efficiently and which can be mass-produced at relatively low cost.

Briefly stated, these objects are attained in a two-piece mobile bar which may house a beverage cooling and dispensing system for selectively dispensing cold beverages through a multi-valved gun operated by a bartender stationed behind the bar. The first piece is a base unit defined by vertical end walls bridged by upper and lower sections, the upper section being joined to the end walls are corresponding positions below the upper edges of the end walls. The space between the upper and lower sections is divided into open cells which receive the beverage containers. The upper section is provided with a sink in which a cold plate is seated, the cold plate having coils embedded therein in heat exchange relationship with ice covering the plate. The coil inputs are coupled to the containers and the outputs to the gun, whereby beverages passing through the coils are cooled before being dispensed.

Coupling is effected by a network of hoses which extend through a shallow region contiguous with the front side of the unit. The second piece of the bar, which is detachable from the first, is an integrated serving counter/apron assembly whose counter rests on the upper edges of the end walls and whose apron covers the front side of the unit and conceals the network of hoses and the containers. But when it becomes necessary to obtain access to the front side of the unit to permit cleaning of the hose network and the containers in order to maintain the bar in a sanitary condition, the assembly is then detached from the unit.

When the mobile bar is used without a dispensing system but is provided with shelves to store bottled sodas, then soda spills and dirt accumulating in the interior of the bar can be more effectively cleaned with the two-piece bar arrangement.

BRIEF DESCRIPTION OF DRAWINGS

For a better understanding of the invention as well as other objects and further features thereof, reference is made to the following detailed description to be read in conjunction with the accompanying drawings, wherein:

FIG. 4A separately shows the latching mechanism for latching the assembly to the base unit;

FIG. 5 is a perspective view of the base unit as seen from its front side with the beverage cooling and dispensing system included therein and the cold plate raised above the unit;

FIG. 6 is a perspective view of another embodiment of a two-piece mobile bar which is adapted to store bottled sodas, the bar being seen from the rear; and FIG. 7 shows one of the removable shelves included in the bar shown in FIG. 6.

DETAILED DESCRIPTION OF INVENTION

The Beverage Cooling and Dispensing System

A two-piece mobile bar in accordance with the invention may be provided with a pre-mix or a post-mix system for cooling and dispensing the beverages. In a pre-mix system, the beverages are fully constituted and are in condition to be served. Thus beverages such as "Coca-Cola" and "Seven-Up" are contained in large supply cylinders or tanks into whose inputs are fed pressurized carbon dioxide drawn from a $CO_2$ cylinder.

In a post-mix system, the beverages are not fully constituted but are in syrup form. Hence syrups drawn from supply cylinders must be intermingled with carbonated water obtained from a carbonator coupled to a water supply. But regardless of whether the system installed in the mobile bar is of the pre-mix or post-mix type, cooling of the beverage takes place in a cold plate having embedded therein cooling coils through which the beverage to be cooled is caused to flow.

But regardless of whether a pre-mix or a post-mix system is employed, it must make use of a network of flexible lines or hoses intercoupling the coils of the cold plate to the containers and the dispensing gun.

Figure 1:
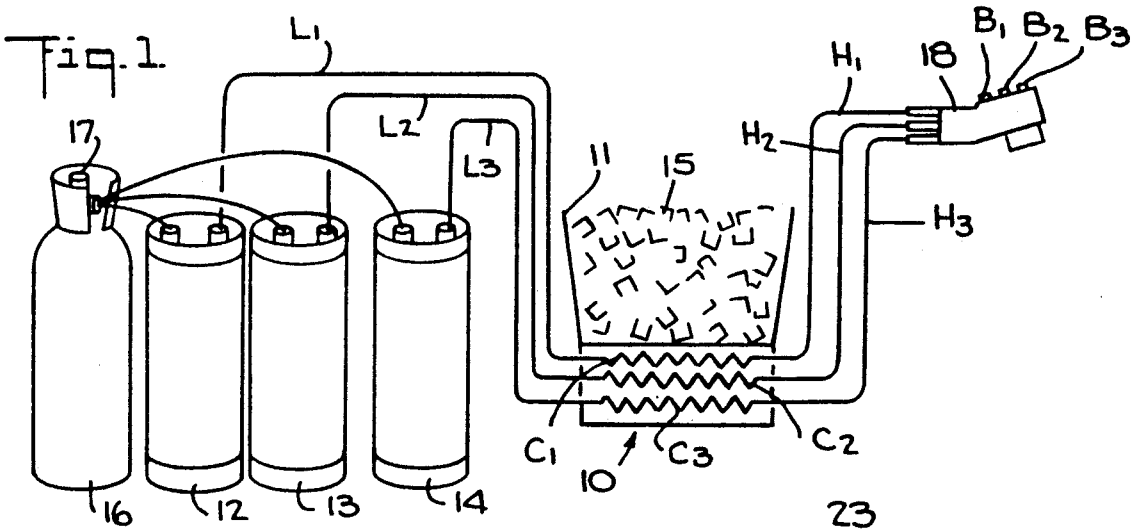
FIG. 1 is a simplified schematic diagram of a pre-mix beverage cooling and dispensing system for inclusion in a two-piece bar in accordance with the invention.
Figure 3:
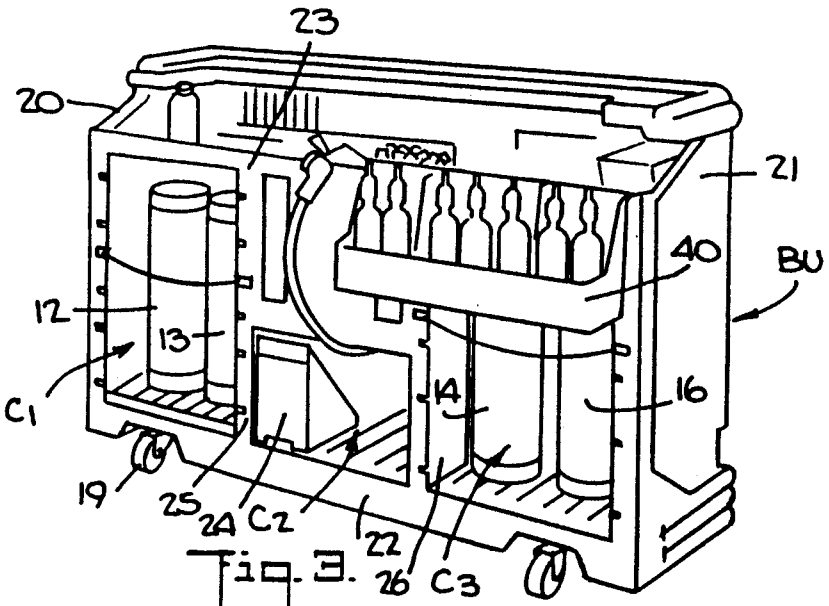
FIG. 3 is a perspective view of the same bar as seen from its rear side.
Figure 2:
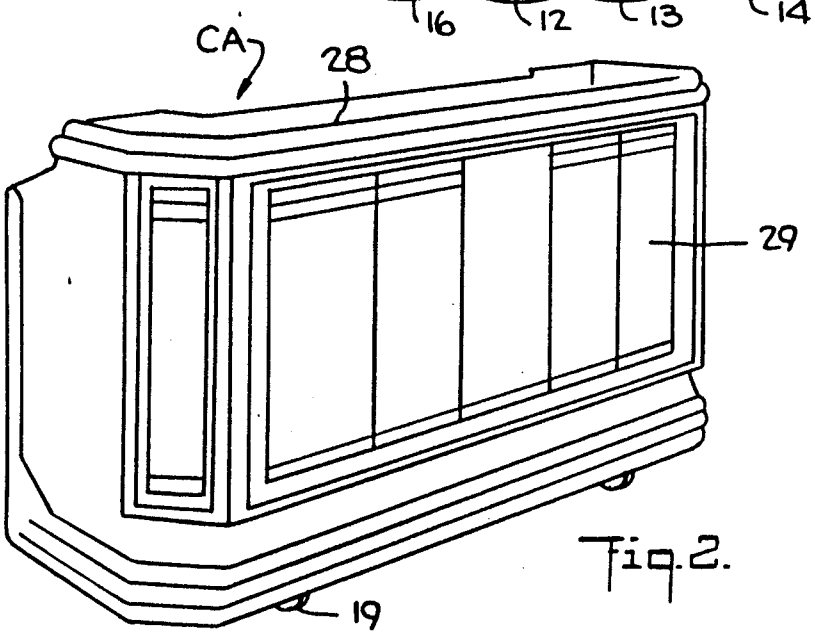
FIG. 2 is a perspective view of one embodiment of a two-piece mobile bar in accordance with the invention as seen from its ,front side.

FIG. 1 schematically illustrates a pre-mix system suitable for a mobile bar in accordance with the invention in which a cold plate 10 seated in a sink 11 in the bar functions to cool the beverages to be dispensed. These beverages are contained in three supply cylinders 12, 13 and 14, and by way of example, one is "Coca-Cola", the second is "7-Up" and the third, tonic soda.

The outputs of cylinders 12, 13 and 14, which typically have a 5-gallon capacity, are fed by upstream lines or hoses $L_1$, $L_2$ and $L_3$ to the input terminals of three coils $C_1$, $C_2$ and $C_3$ embedded in cold plate 10 seated in sink 11 and covered by ice cubes 15. The coils, which are in a spiral or serpentine shape in order to increase their overall length within the confines of the cold plate, are in heat exchange relationship with ice cubes or whatever other form of ice is used. As a consequence, heat is transferred from the beverages flowing through these coils, the heat acting to melt the ice cubes. Hence it is necessary to provide the sink with a drain to discharge the melted ice.

In order to pressurize the sodas contained in cylinders 12, 13 and 14 so as to force the beverages out of the cylinders, pressurized carbon dioxide contained in a $CO_2$ tank 16 is fed by way of a pressure regulator 17 into the inputs of cylinders 12, 13 and 14.

The output terminals of cold plate coils $C_1$, $C_2$ and $C_3$ are coupled through downstream hoses $H_1$, $H_2$ and $H_3$ to a hand-held dispenser gun 18 having button-controlled valves operated by buttons $B_1$, $B_2$ and $B_3$. Thus when an operator of the gun actuates button $B_1$, Coca-Cola is discharged from the nozzle of the gun.

In practice, the system will usually include more than three beverage supplies; hence if there are six supplies, the cold plate must have six cooling coils, one for each beverage. And the system may be of the post-mix type rather than the pre-mix type illustrated. But in either case, a network of hoses is included in the system; and to maintain the system in a sanitary condition, the network of hoses and all other elements of the system must be cleaned.

The Two-Piece Mobile Bar

Figure 4:
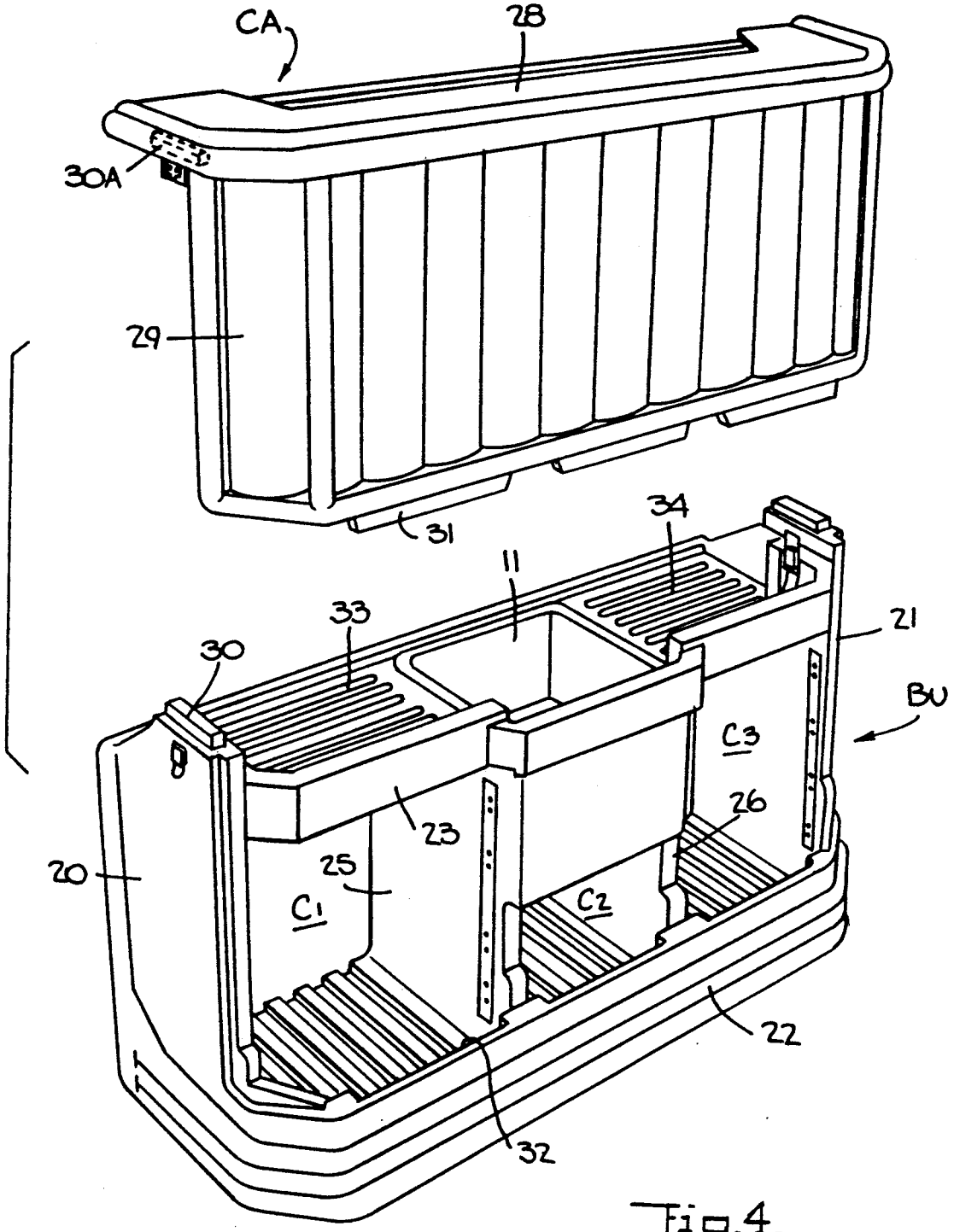
FIG. 4 is a perspective view in which the integrated serving counter-apron assembly piece is detached from the base unit piece, the base unit being shown with the beverage cooling and dispensing system omitted.

A two-piece mobile bar in accordance with the invention in which a pre-mix system is installed is illustrated in FIGS. 2 to 5, the system being omitted in FIG. 4 so that only the structure of the bar itself is shown in this figure. One of the pieces is a generally rectangular base unit BU, the other piece being a serving counter/apron CA which is detachable from the base unit to facilitate cleaning operations to maintain the bar in a sanitary condition.

Base unit BU may in practice be constructed mainly of synthetic plastic material. Thus the counter of the assembly may be a laminate of particle board and plastic skins, and the walls of base unit BU may be formed of a laminate of a urethane foam plastic core sandwiched between plastic facing sheets. Alternatively, the bar may be formed in whole or in part of wood, metal and other structural materials.

Attached to the underside of base unit BU adjacent its corners are casters 19 so that the bar may be wheeled without difficulty to any desired site. Base unit BU includes a pair of vertical end walls 20 and 21. These walls are bridged by a lower horizontal section 22 joined to and integral with end walls 20 and 21, and an upper horizontal section 23 joined to and integral with the end walls at corresponding positions somewhat below the upper edges of the end walls so as to provide access to the sink and other elements supported on the upper section.

Incorporated in upper section 23 at its center is the sink 11 in which a seated cold plate 10 having coils embedded therein which are in heat exchange relation with ice. As shown in FIG. 1, the cold plate is covered by a load of ice cubes 15. Sink 11 drains into a wastewater tank 24 disposed in an open cell below the sink.

The space between the upper and lower sections 22 and 23 is divided by partition walls 25 and 26 into three open cells $C_1$, $C_2$ and $C_3$. Received in cell $C_1$ are the beverage supply cylinders 12 and 13 of the pre-mix system, the beverage supply cylinder 14 and the $CO_2$ tank 16 being received in cell $C_3$. The network of hoses $L_1$, $L_2$, $L_3$ and $H_1$, $H_2$ and $H_3$, which intercouple the cold plate coils to gun 18 all extend through a shallow region contiguous with the front side of the bar unit so that these hoses and the containers in the open cells are all accessible for cleaning when the counter/apron assembly is detached from the unit.

It is to be noted that cold plate 10 is provided with a set of input terminals and a set of output terminals T for the coils embedded in the cold plate, so that the cold plate has a capacity to handle a like number of beverage supply cylinders. Only some of these cylinders are visible in FIG. 5, the remaining cylinders are disposed behind these cylinders within the open cells of the base unit.

The serving counter/apron assembly CA, which is detachable from base unit BU, is constituted by a counter 28 which is seated on the upper edges of end walls 20 and 21 and an apron 29 which covers the front side of the unit and the contiguous shallow region through which extend the network of coupling hoses. Hence the apron normally conceals both the network of hoses and the various containers housed in the open cells.

The upper edges of end walls 20 and 21 of the unit are provided with tabs 30 which are received in tab sockets 30A formed at corresponding positions at the ends of counter 28. Tabs 31 at the lower edge of apron 29 are accommodated in complementary recesses 32 in lower section 22 in the base unit. A pair of draw latches DL are provided (shown separately in FIG. 4A) whose latch receiver LR is secured to counter 28 and whose latching mechanism LM is secured to end walls of the base unit. Hence when the assembly is latched onto the base unit, both the counter and the apron are held in place.

Base unit BU is provided on either side of the sink with small work counters 33 and 34.

Hooked onto a ledge on upper section 23 is a so-called speed rail 40 which accommodates bottles of Scotch whisky and other hard liquors.

Thus a bartender stationed at the rear of the bar can prepare drinks containing hard liquor and ice cubes, and use for this purpose liquid obtained from the speed rail and ice cubes from the sink. Or he can provide soft drinks using dispensing gun 18 for this purpose.

When the need arises to clean the bar thoroughly, counter/apron assembly CA is then detached from base unit BU, thereby giving full access to the network of hoses and the containers disposed in the open cells. In this way, a bar may be maintained in a sanitary condition whether the system installed therein is of the pre-mix type, as shown, or of the post-mix type.

Modified Mobile Bar

In the two-piece mobile bar shown in FIG. 6, which is essentially the same as the bar shown in the previous figures, instead of open-cell compartments in the base unit serving to accommodate one or more supply cylinders of a soda dispensing system, it is used to store bottled or canned sodas. For this purpose, wire shelves $S_1$ and $S_2$ are installed in this cell.

As shown separately in FIG. 7, each shelf is provided at its front end with a horizontal beam 35 to which is joined the front end of a grid 36 of wires. The grid 36 is provided with hooks 37 and 38 at its rear corners.

To install a shelf, the ends of beam 35 are inserted in slots in the side walls of the cells, hooks 37 and 38 going over the ears (not shown) projecting from the side walls. The placement of the slots and ears is such that a shelf may be installed in the cell at different elevations therein to occupy either a position in which shelf $S_2$ is shown or the downwardly tilted position in which shelf $S_1$ is shown. When the shelf is downwardly tilted and is stacked with cans or bottles, these are gravity fed toward the front of the shelf so that when a can or bottle is removed from the front of the stack, it is replaced by the next can or bottle in the inclined stack.

While there has been show and described a preferred embodiment of a mobile bar for dispensing cold beverages in accordance with the invention, it will be appreciated that many changes and modifications may be made therein without, however, departing from the essential spirit thereof.

We claim:

1. A mobile bar having installed therein a beverage cooling and dispensing system including a cold plate having coils embedded therein intercoupled by a network of hoses to a dispensing gun, and beverage and other containers housed in the bar, said bar comprising:

(a) a generally rectangular base unit having open front and rear sides defined by a pair of vertical end walls bridged by upper and lower horizontal sections, the upper section being joined to the end walls below their upper edges, the space between the sections being divided into open cells in which the containers are received, said upper section being provided with a sink in which the cold plate is seated and is covered by ice in heat exchange relation with the coils, the network of hoses extending through a shallow region contiguous with the front side of the unit; and (b) a serving counter/apron assembly detachable from the base unit, said assembly including a counter that is seated on the upper edges of the end walls and an apron that covers the open front side of the unit and conceals the network of hoses and the containers, whereby when said assembly is detached from the unit, the network of hoses and the containers are then exposed so that they may be cleaned as well as the interior of the base unit to maintain the bar in a sanitary condition.

2. A mobile bar as set forth in claim 1, wherein said unit is provided with casters so that the bar may be wheeled to a desired site.

3. A mobile bar as set forth in claim 1, wherein said bar is divided by partition walls into said cells.

4. A mobile bar as set forth in claim 3, wherein one of said cells accommodates said sink and a wastewater tank therebelow into which said sink drains.

5. A mobile bar as set forth in claim 1, wherein said counter is provided at either end with a latching element that is received in a latching socket in the corresponding upper end of one of the vertical end walls.

6. A mobile bar as set forth in claim 5, wherein said apron is provided at its lower edge with a tab that is received in a complementary recess in the lower section of the base unit.

7. A mobile bar as set forth in claim 1, wherein said gun is a multi-valved gun coupled through a manifold to said network of hoses.

8. A mobile bar as set forth in claim 1, wherein said upper section is provided at either side of said sink with a work counter.

9. A mobile bar as set forth in claim 8, wherein said upper section is provided with a well between each work counter and one of said end walls.

10. A mobile bar as set forth in claim 1, wherein said unit is provided with speed rails hooked onto said upper section at the rear side of said bar to accommodate liquor bottles.

11. A mobile bar as set forth in claim 1, wherein said system is a pre-mix beverage system.

12. A mobile bar for dispensing beverages comprising:

(a) a generally rectangular base unit having open front and rear sides defined by a pair of vertical end walls bridged by upper and lower horizontal sections, the upper section being joined to the end walls below their upper edges, the space between the sections being divided into open cells in which containers and other items are received, said upper sections being provided with a sink; and (b) a serving counter/apron assembly detachable from the base unit, said assembly including a counter that is seated on the upper edges of the end walls and an apron that covers the open front side of the unit, the containers and other items, whereby when said assembly is detached from the unit, the containers and other items are then exposed so that they may be cleaned as well as the interior of the base unit to maintain the bar in a sanitary condition.

13. A mobile bar as set forth in claim 12, wherein one of said cells is provided with removable shelves to accommodate soda containers.

14. A mobile bar as set forth in claim 13, wherein said shelves are supported in said cell in a horizontal or downwardly tilted state.

* * * * *